United States Patent [19]

Heiligman et al.

[11] Patent Number: 4,535,918

[45] Date of Patent: Aug. 20, 1985

[54] DISPENSER WITH SQUEEZE-BULB ACTUATOR

[76] Inventors: Randy B. Heiligman, 10411 S. Cedar Lake Rd., Minnetonka, Minn. 55343; Paul Keller, 9404 NW. East River Rd., Coon Rapids, Minn. 55433

[21] Appl. No.: 500,765

[22] Filed: Jun. 3, 1983

[51] Int. Cl.[3] ..... B67D 5/00

[52] U.S. Cl. ..... 222/185; 222/209; 222/213; 222/464; 222/401

[58] Field of Search ..... 222/152, 181, 185, 630–633, 222/325, 335, 372, 373, 382, 364, 251, 505, 508, 526, 531, 538, 536, 537, 544, 547, 556, 564, 568, 209, 211, 394, 400.5, 213

[56] References Cited

U.S. PATENT DOCUMENTS

| | | | |
|---|---|---|---|
| 581,491 | 4/1897 | Richardson | 222/209 |
| 1,303,696 | 5/1919 | McGregor | 222/213 |
| 1,515,127 | 11/1924 | Levinthal | 222/505 |
| 1,601,593 | 9/1926 | Nelson | 222/213 |
| 2,143,494 | 1/1939 | Nelson | 222/400.5 |
| 2,327,285 | 8/1943 | Opitz | 222/400.5 |
| 2,612,297 | 4/1950 | Bain | 222/394 |
| 2,679,337 | 5/1954 | Leach | 222/209 |
| 4,223,809 | 9/1980 | Martin | 222/96 |

FOREIGN PATENT DOCUMENTS

| | | | |
|---|---|---|---|
| 2926221 | 8/1981 | Fed. Rep. of Germany | 222/556 |

*Primary Examiner*—Joseph J. Rolla
*Assistant Examiner*—Louise S. Heim
*Attorney, Agent, or Firm*—Hugh D. Jaeger

[57] ABSTRACT

Dispenser for dispensing thick liquids such as catsup, mustard, salad dressing or the like, and including a configured housing with a base for supporting a bottle with the mouth screwed into the base in upsidedown configuration, an air squeeze bulb connected through a channel in the base to an air tube extending up through the neck of the bottle and into an upper portion of the bottle, a thick liquid channel from the top of the housing to a spout in the configured housing for flow of the thick consistency of the contents, and a spring lever actuated by the air squeeze bulb so that the lever opens the spout on squeezing of the air squeeze bulb and introducing air into the bottle thereby forcing the thick consistency liquid down through the channel in the configured housing through the spout in a desired measured quantity. The dispenser, based on the size of the bottle receiving opening, can accept catsup, mustard, salad dressing, or other like bottles for accurate dispensing of predetermined measured quantities dependent upon the size of the air bulb for introducing an amount of air which is a function of the amount of liquid dispensed.

9 Claims, 7 Drawing Figures

DISPENSER WITH SQUEEZE-BULB ACTUATOR

BACKGROUND OF THE INVENTION

1. Field of the Invention

The present invention pertains to a dispenser and, more particularly, to a dispenser for thick liquid types of product such as catsup, mustard, salad dressing or the like.

2. Description of the Prior Art

The prior art has been replete with dispensers for such products as catsup and mustard. All of the prior art devices have usually operated either in a pump-style fashion for pumping liquid out from a reservoir, from a squeeze bottle where the squeeze bottle is turned upside-down and the bottle is squeezed, or from a gravity feed system which is least common in usage. All of the prior art systems have had problems with getting the liquids to flow, flowing at an even rate, or providing for clean-flow, even dispensing.

The pump type of dispensers has been less than adequate, as it always takes a certain number of pumps to "prime the system," and never providing for even dispensing with even consistency and measured quantities.

The oldest type of dispenser utilized is the squeeze bottle, which while being inexpensive and readily utilized worldwide, the bottles have always been lacking in appeal as well as function. The bottles tend to blow out a quantity of air, the juices of the contents before the intended thickness of the content itself, and provide a minimal amount of control until the juices are readily flowing.

It is also a problem that the liquids are sprayed other than where directed due to air bubbles and other particular problems for that type of dispenser.

The gravity flow dispensers are very uncommon, but have been utilized in larger high-volume dispensing applications. Usually these gravity-type dispensers are for commercial and kitchen use rather than for an individual's use such as at a hot-dog or hamburger stand.

Other prior art problems of the prior art dispensers are that the prior art dispensers do not totally empty themselves of catsup or other liquid. The dispensers always have a residual amount remaining behind after the final squeeze or emptying. Further, additional problems of the prior art dispensers are the motions and time required for refilling the dispensers which usually includes putting catsup or other liquid from a larger volume storage jar or the like into a smaller volume dispenser, which means dispensing liquid from a larger lip device into a smaller lip device.

The present invention overcomes the disadvantages of the prior art by providing an attractive, aesthetically designed dispenser for dispensing of catsup, mustard, salad dressing or the like contents in a sanitary fashion, providing for dispensing of predetermined measured quantities and providing for attractiveness of the product as well as the dispenser. The dispenser of the present invention also empties total contents of the catsup or the like from the dispenser. The present invention provides that a bottle only be turned upside-down or at an angle with the dispenser provided for automatic filling of the dispenser. Gravity flow between the bottle as well as a positive air pressure provides for other filling through the base channels of the dispenser.

SUMMARY OF THE INVENTION

The general purpose of the present invention is to provide a catsup, mustard, salad dressing or the like dispenser in a sanitary fashion for dispensing of product at tableside, in a kitchen setting, or wherever else such as on a picnic table. The dispenser is transportable and of a cost within the range of the average family or group to purchase. The dispenser includes an air squeeze bulb actuated lever for controlling the dispensing of liquid in predetermined quantities upon actuation. The dispenser is hand-held and is easily utilizable by any member of the family, from small child to parent or kitchen help in a commercial setting.

Other general purposes of the present invention include eliminating accidental over-usage or spilling of the contents. A cap is not required to be utilized with the present invention. The present invention also resolves the problem of repeated stroking or shaking of the bottle. The dispenser is transportable, and the average cost to an individual or family group is considered inexpensive to cheap.

One significant aspect and feature of the present invention is a dispenser for food-related products which is sanitary and easily loaded with the product. The bottle is unscrewed out of the base and the new bottle is screwed in, and there is included a liquid-holding chamber such that the contents will not flow out around the neck of the bottle or in any other way during the loading and securing of the bottle into the configured housing and base.

Another significant aspect and feature of the present invention is a dispenser which is sanitary and can be readily cleaned such as putting the whole dispenser into a dishwasher or into a sink of water for washing as well as sterilizing where appropriate. The configured base and housing would be made of a plastic or the like material, or could even be made of stainless steel where appropriate, but in any case is not only washable but is also sterilizable as desired.

An additional significant aspect and feature of the present invention is that the dispenser will accommodate any size bottle as long as the neck and lip diameter remain the same. This is particularly advantageous for catsup bottles, which are in numerous physical sizes and where the mouth diameter opening of the bottle is always identical.

A further significant aspect and feature of the present invention is a dispenser which can include adapters to accept bottles with different diameters where the adapters are screwed into the base of the dispenser.

Having thus described one embodiment of the present invention, it is the principal object hereof to provide a dispenser for products such as catsup, mustard, salad dressing or the like.

One object of the present invention is that the dispenser can be operated by one hand and is easy to operate. It is only necessary to squeeze the air bulb to not only open an internal lever but to have air introduced into the bottle for forcing a liquid such as catsup out the spout.

Another object of the present invention is the self-closing spout which includes an air bulb actuated lever with a lever which closes the spout and is spring-biased into a closed position.

An additional object of the present invention is an air bulb which only requires a single squeeze for flowing of the liquid such as catsup, contrary to the prior art which required several priming pumps or shaking.

Still another object is a dispenser which dispenses the total contents of the bottle based on the flow of gravity as well as a positive pressure flow due to the air bubble action.

A further object of the present invention is a dispenser which is utilizable in commercial establishments as the dispenser and attached bottle are tamper resistant. A suitable plastic setscrew or the like can also be provided in the dispenser base for securing the bottle in position to avoid any undue tampering.

BRIEF DESCRIPTION OF THE DRAWINGS

Other objects and many of the attendant advantages of the present invention will be readily appreciated as the same becomes better understood by reference to the following detailed description when considered in connection with the accompanying drawings, in which like reference numerals designate like parts throughout the figures thereof and wherein.

DESCRIPTION OF PREFERRED EMBODIMENTS

Figure 1:
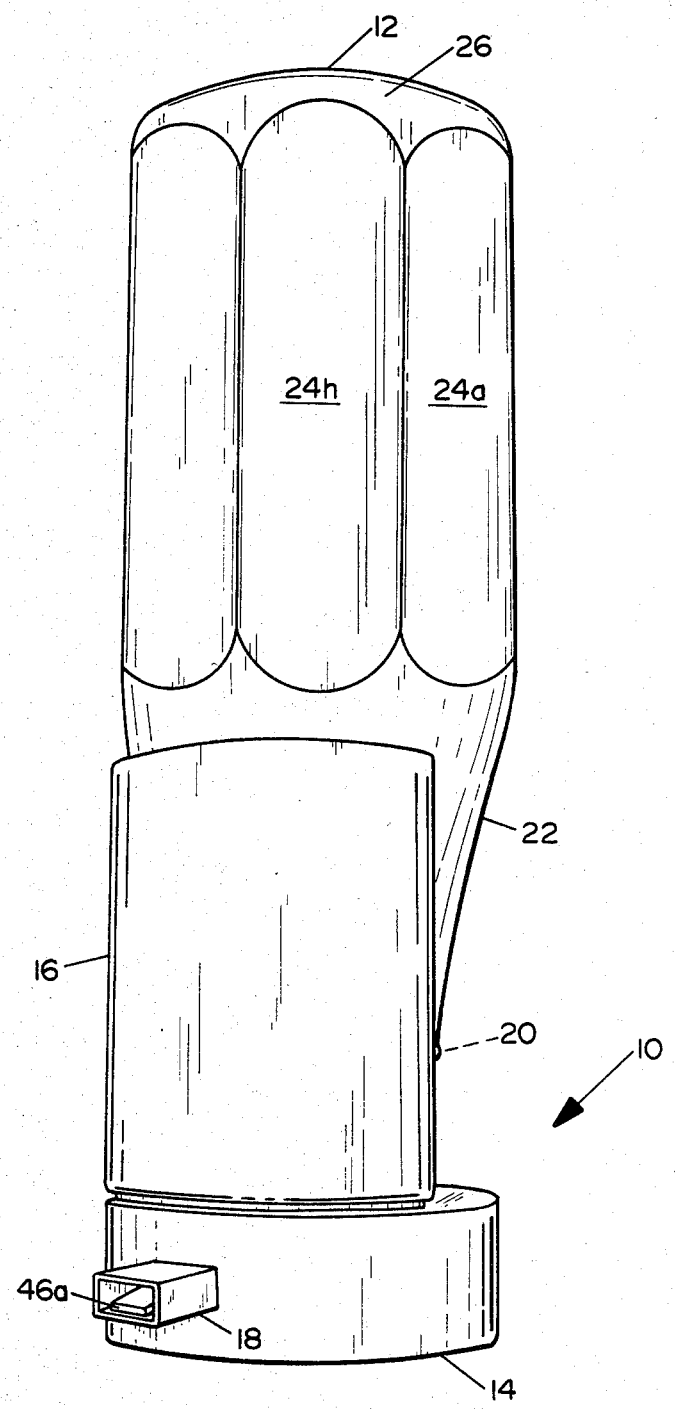
FIG. 1 illustrates a perspective view of a dispenser, the present invention, including a catsup bottle screwed into the configured base and encompassed by a configured air bulb housing.
Figure 4:
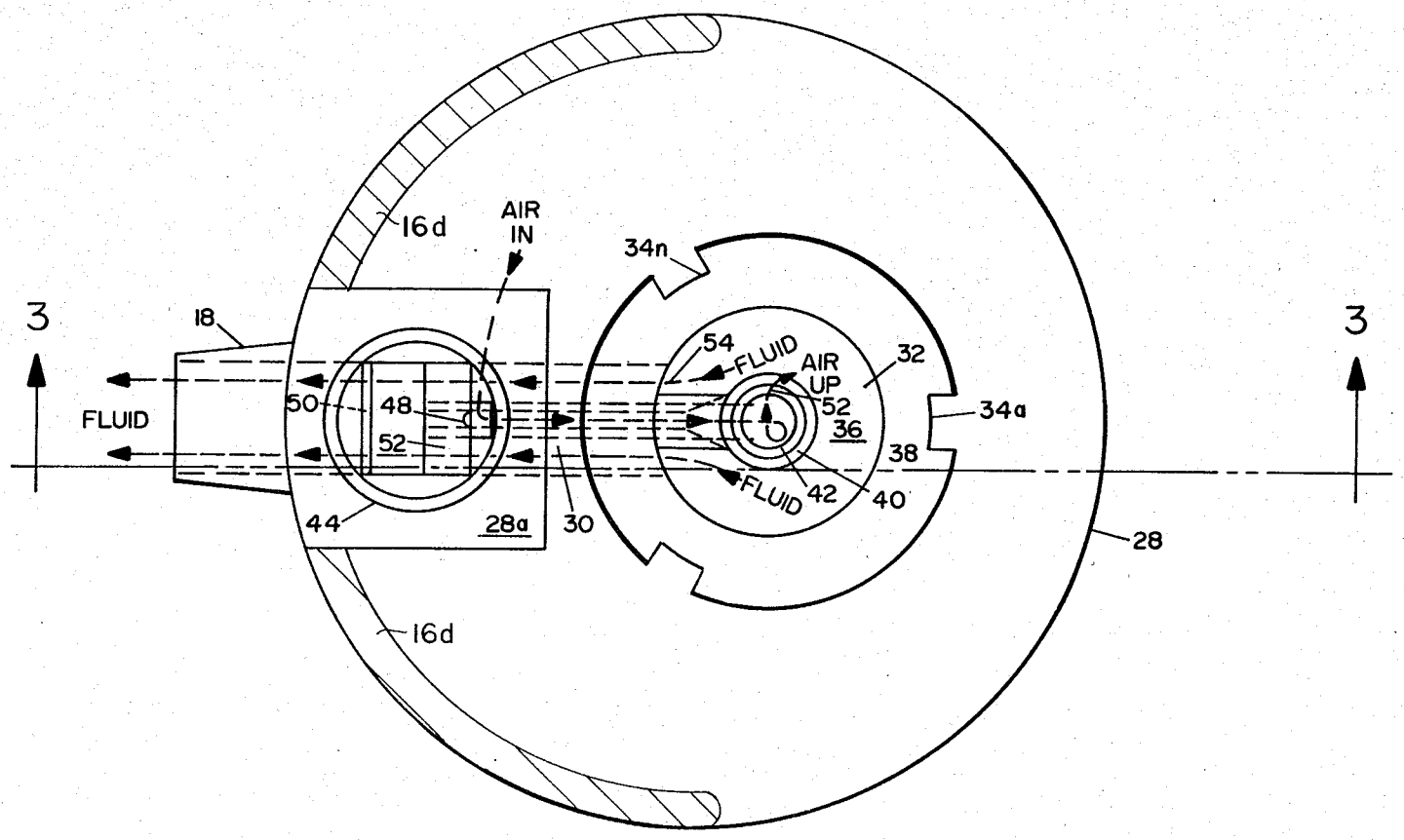
FIG. 4 illustrates a top view of the dispenser.

FIG. 1 illustrates a perspective view of a dispenser 10 including a bottle 12 such as a catsup bottle or the like, a configured housing including a base 14, an air-squeeze bulb 16, and a spout 18. In this particular embodiment and by way of example and for purposes of illustration only and not to be construed as limiting of the present invention, the catsup bottle 12 includes a screw top 20 of FIG. 7, an angled neck 22, an eight-sided lower portion 24*a*–24*h*, and a base 26. The catsup bottle while having a constant perimeter screw top 20, can be configured to include 14, 24, 32 or 44 ounces of catsup as is presently bottled and sized by a number of companies worldwide. This appears at the time of this disclosure to be the common sizes in the industry for purposes of handling as well as stocking on grocery shelves and by grocery wholesalers and restaurant wholesalers. A spring-biased lever of FIGS. 5 and 6 includes a spout-closing end portion 46*a*. The air-squeeze bulb 16 encompasses a portion of the angled neck 22 and has a finite width providing for the ejection of a predetermined amount of air from the air-squeeze bulb into the catsup bottle 12 which is a function of the amount of fluid dispensed. The air squeeze bulb can take any particular shape with any particular volume and has been illustrated for purposes of design as encompassing the catsup bottle in a functional and practical sense. The air bulb 16 could be substituted by any type of air-squeeze bulb having any particular geometrical configuration of any size and does not have to encompass the bottle, but only engage over the chamber walls 44 to provide for passage of air and an air passage integrity sealed between the walls of the bulb and the chamber. FIG. 4 shows that the chamber walls 44 take a circular shape which is molded into the bottom of the air squeeze bulb.

Figure 2:
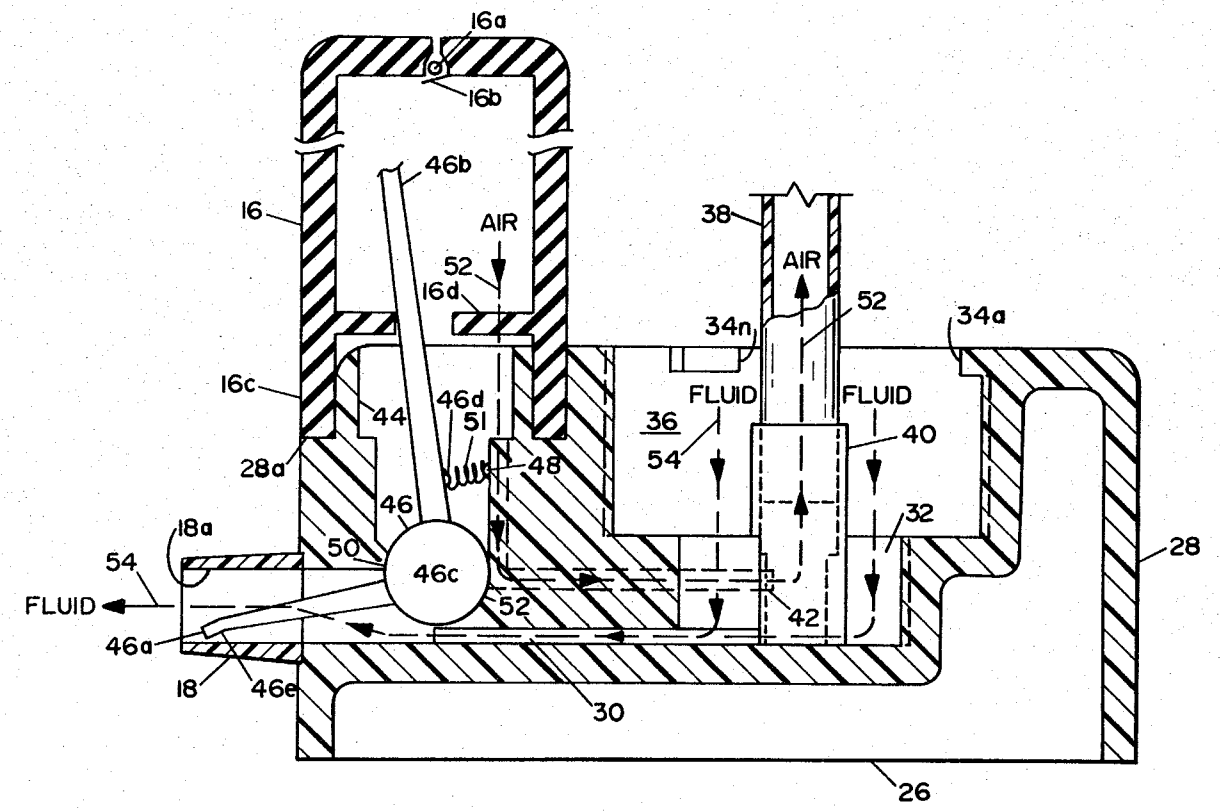
FIG. 2 illustrates a cross-section view of the dispenser.

FIG. 2, which illustrates a cross-section view of the invention, illustrates a geometrically configured housing 28 including a base 26, a spout 18 including a rectangular interior hole 18*a*, a liquid flow horizontal channel chamber 30, and a liquid flow vertical chamber 32 in direct interconnecting relationship. A plurality of keyways 34*a*–34*n* project inwardly for screwing the top of the bottle 12 into a bottle-receiving chamber 36. An air tube 38 engages into a vertical air tube socket chamber connection 40 interconnected directly to an air tube passage 42 and then to an air tube vertical ball chamber 44. The round bottom air ball 16 frictionally engages about the chamber wall 44. A lever 46 including a spring 48 pivots in pivot rounds 50 and 52. The right-angled lever 46 includes a spout closing end portion 46*a* and a ball actuator lever 46*b*. The lever 46 frictionally engages in between the pivot rounds 50 and 52 and is retained therebetween. The fit is frictional engagement about the round 50 retaining the ball 46*c* in the rounds. Nipple 46*d* on the back side of lever 46*b* and nipple 48 are provided for capturing ends of a spring 50. An angled portion 46*e* is provided on the lever for secure closing. The air squeeze bulb 16 is provided with a valve bulb 16*a* and a valve flap 16for passage of air into the bulb after the squeezing process and also preventing the escape of air during the squeezing process. Arrow 52 indicates the air flow path while arrow 54 indicates the fluid flow path. The housing 28 can be a suitable molded plastic or machined plastic such as Lexan or the like, and the channels and chambers can be drilled or molded into the configured housing. The lever 46 easily pops into position, the spring 50 is engaged about the nipples, and the air tube 38 is attached whose height is dependent upon the size of the bottle. Only a minimal length of air-flow tubing needs to be used, but preferably the tubing is of such a height as to extend just slightly below the bottom of the bottle when the bottle is turned upside-down and engaged about the keyways 34*a*–34*n*. The air-flow path provides positive pressure exerted into the bottle with the air rising to the top of the bottle during the squeezing process. The fluid-flow path is caused by positive pressure at the upper portion of the bottle driving the fluid in a downward nature due to the heavy consistency of the liquid, free fall of the liquid under gravity, and the slight positive air pressure which is exerted, thereby propelling the fluid out the spout when the lever is rotated, raising the end 46*a*.

Figure 3:
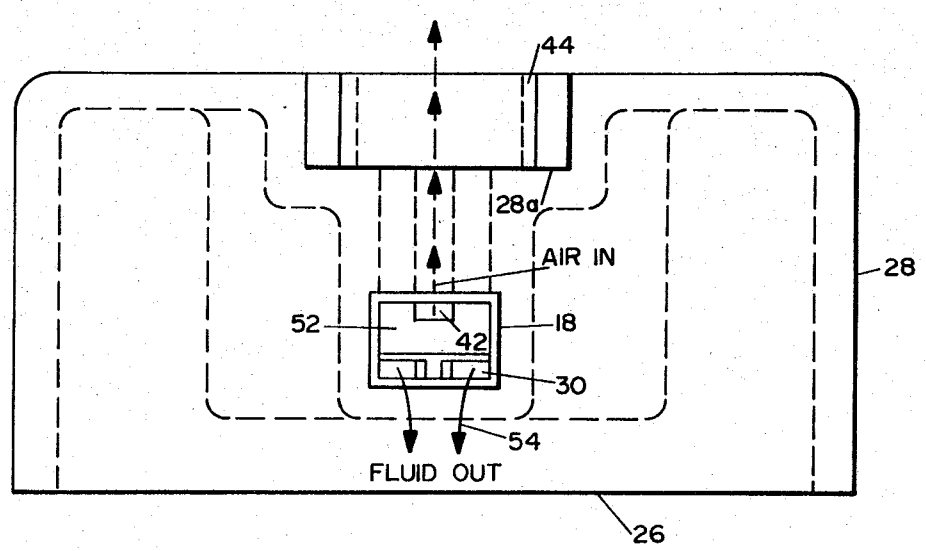
FIG. 3 illustrates an end view of the dispenser.

FIG. 3 illustrates an end view taken where all numerals correspond to those elements previously described. Particularly, the spout 18 is illustrated along with the associated channels for fluid flow and air flow. The end view is illustrated with the lever 46 out of position, for purposes of illustration.

FIG. 4 illustrates a top view partially cut away where all numerals correspond to those elements previously described. Particularly, the air-flow chamber 40 and the liquid-flow chamber 32 are illustrated in an encompassing relationship. The figure illustrates particularly how the fluid flows down and about the socket and out through the liquid-flow horizontal channel chamber 30. The round chamber wall 44 is illustrated for engaging the bottom lip 16*c* of the air bulb 16. The base of the air bulb 16*d* rests on the top 28*a* of the configured housing.

Figure 5:
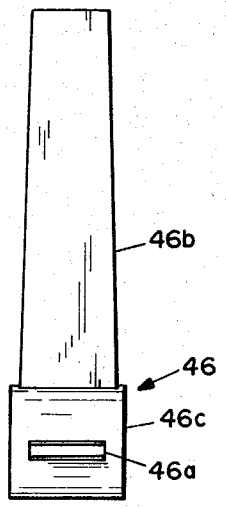
FIG. 5 illustrates an end view of a spring-biased lever.

FIG. 5 illustrates an end view of the spring lever where all numerals correspond to those elements previously described.

Figure 6:
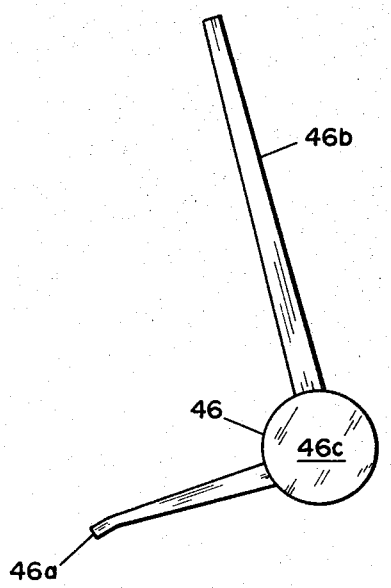
FIG. 6 illustrates a side view of the spring-biased lever.

FIG. 6 illustrates a side view of the spring lever actuated spout closure where all numerals correspond to those elements previously described.

Figure 7:
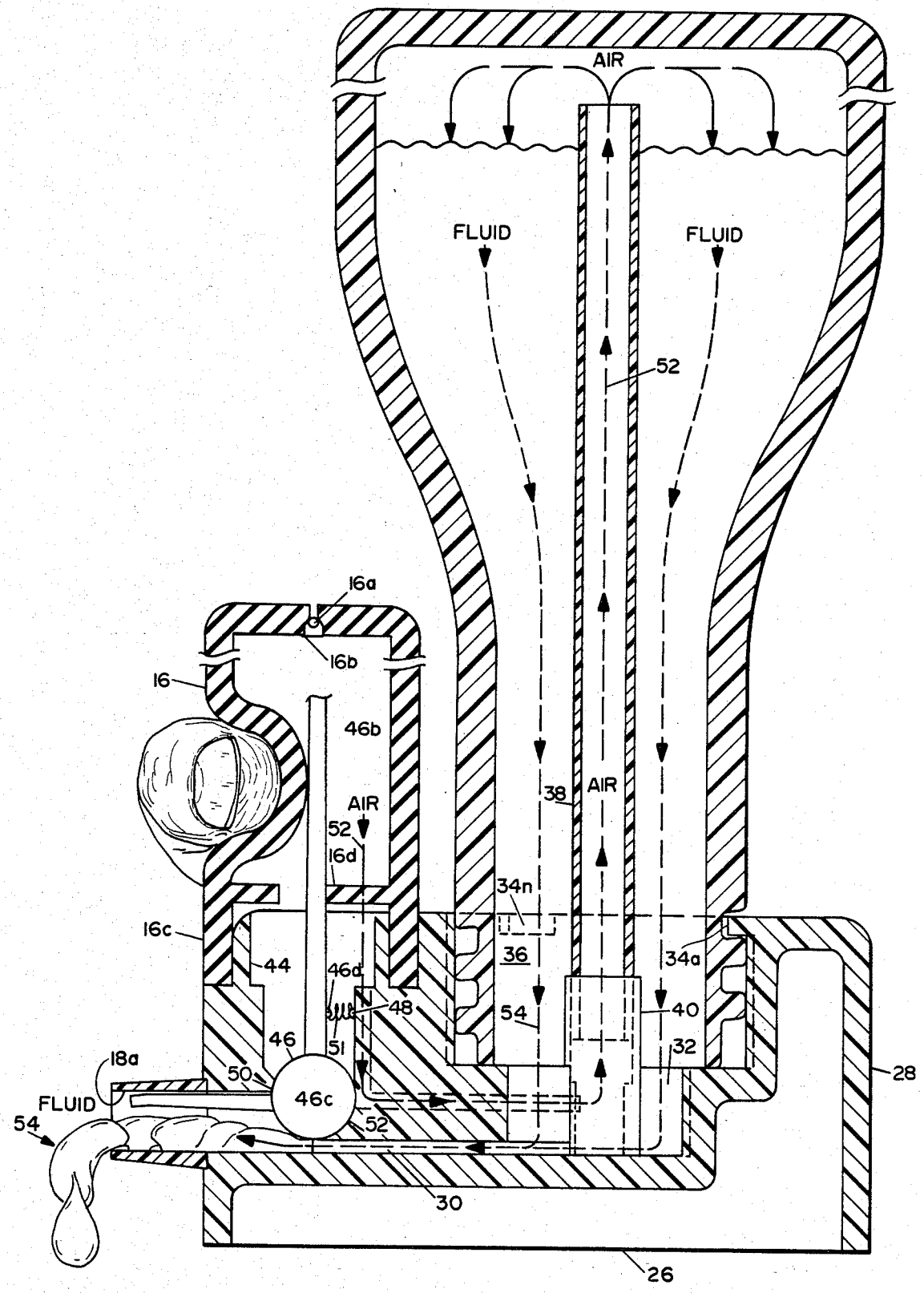
FIG. 7 illustrates a side view of the dispenser, a cutaway view of the air bulb, cutaway view of the bottle, and the lever of FIGS. 5 and 6 in an open position for dispensing of thick, dense liquid.

FIG. 7 illustrates a side view where all numerals correspond to those elements previously described.

MODE OF OPERATION

FIG. 1 illustrates that the bottle such as a catsup bottle is turned upside-down and rotated such that the screw top 20 of the bottle engages within the keyway lips 34*a*–34*n*. Gravity will provide for initial flow of the liquid to fill into the liquid-flow chambers 30 and 32. While it is unlikely, an initial squeeze of the air bulb 16 may be required. In usual practice, though, the full bottle will provide significant weight due to the gravity on the fluid that no positive pressure through squeezing of the air bulb will be required and the chambers will automatically be primed with the liquid such as catsup.

On dispensing a predetermined amount of liquid which is dependent upon the size of the air squeeze bulb which can be any suitable size and not to be construed as limiting of the present disclosure, which is by way of example and for purposes of illustration only, the air bulb 16 is squeezed, thereby pushing the lever 46 forward and opening the spout so that the liquid such as catsup comes out of the end 18*a* of the spout. This provides for dispensing liquid such as catsup for hot dogs, hamburgers, french fries or the like. In dispensing, air is passed up through the air tube to the bottom of the bottle 12 providing positive pressure of just the right desired pressure for forcing the fluid downward through the fluid chamber. This positive flow in a downward direction through the spout which is opened and closed by the lever which is actuated by the squeeze bulb provides for positive flow but also for a certain vacuum flow when no air is introduced in through the air spout, thereby in effect providing for a positive suction basis as to non-flow of the liquid.

The particular condiment dispensed can also include mustard, light relishes, mayonnaise or the like. The base can be molded or machined to fit the desired size bottle, as most of the condiment bottles are sized in a somewhat standard sizing arrangement.

The housing and rubber air bulb are constructed of such materials as Lexan, plastic and rubber for the air bulb such that the components are dishwasher safe in home kitchens and also in commercial kitchens.

FIG. 7 illustrates the squeezed air bulb, the lever as pivoted, and the compressed spring. As a predetermined volume of air flows upwards, a predetermined volume of liquid flows downwards as the spout is opened by the lever arm. The lever is held in an open position by the thumb or like hand member working against the spring action biasing the lever through the portion of the air squeeze bulb. When thumb or finger pressure is released, the spring pushes the lever back to a neutral position as in FIG. 2, the air squeeze bulb returns to a normal posture, and the valve opens to allow the bulb to fill with air while returning to a normal position. Accordingly, the spout is closed to the flow of liquid by the downward action of that portion of the lever. The bottle of liquid is shown screwed and engaged into the keyways with the air tube above the liquid level. The height of the air tube can be adjusted accordingly to the height of the bottle with a shear of the scissors. The housing and rubber air bulb can also be constructed of a.b.s., a plastic. In operation, the forefingers of a right-handed person actuate the squeeze air bulb which in turn actuates the lever.

The closing spout lever assembly can also be admitted with the use of a manual closing spout such as a cap which would be attached in a more permanent nature, thereby realizing a cost reduction in the dispenser. The ornamental squeeze air bulb which surrounds the catsup bottle could also be substituted by an actual similar oval-shaped squeeze air bulb which would not be as ornamental and design functional, but would accomplish the same end result. The spout closure such as a cap can also be positioned on the outside of the spout.

Various modifications of the present invention can be made without departing from the apparent scope thereof. The size of the air squeeze bulb determines the amount of liquid being dispensed along with the physical dimensions of the air chamber as well as the fluid flow chamber. Introducing large volumes of air into the bottle will of course result in larger quantities of fluid being dispensed and likewise small quantities of air will dispense small quantities of fluid. The specific contents can be catsup, mustard, salad dressing, hamburger or hot-dog relish or the like. Fluids, liquids, and solid-liquid-fluids will flow accordingly. The device can be manufactured of plastic or stainless steel, preferably a plastic or metal which is dishwasher proof and commercial kitchen dishwasher proof. The base can be of several designs including octagonal, oval, square, rectangular or the like. The manual closing spout attached in a permanent nature can also be utilized in conjunction with the lever or in lieu of the lever assembly.

Having thus described the invention, what is claimed is:

1. In combination, a bottle and dispenser, bottle including:

a. bottle including a screw top lip;

b. dispenser including a housing with an air input channel, and a liquid output channel, said air input channel running downward from an upper portion of the housing, through said housing, into a tube extending upward, a bottle receiving hole surrounding said tube, a liquid dispensing chamber running from said bottle receiving hole to a spout; and, c. a squeeze air bulb connected to said air input chamber and encompassing a portion of said bottle, and a lever positioned in said liquid dispensing channel within said spout, and in said squeeze bulb whereby squeezing said squeeze bulb pivots said lever in said spout to allow for passage of fluid.

2. Dispenser comprising:

a. housing including an air input channel, a liquid output channel including means for receiving a screw top of a bottle, a spout connected to the liquid output channel, a tube running up through said bottle from said air input receiving channel;

b. air squeeze bulb connected to the air input channel, configured to surround at least a portion of the bottle, and for introducing predetermined measured amounts of air into said bottle which will provide for dispensing of predetermined measurements of the fluid content; and, c. lever means connected in said housing means, lever including two arms, a first arm actuated by the air squeeze bulb, the second arm positioned in the spout so as to open the spout when the first lever is squeezed by the air squeeze bulb, and a spring biasing the spout lever in a closed position when not actuated to control the flow of liquid.

3. Dispenser of claim 2 wherein said bottle is a catsup bottle.

4. Dispenser of claim 3 wherein said air-squeeze bulb encompasses a portion of a neck of said bottle.

5. Dispenser of claim 2 wherein said air-squeeze bulb includes a valving means.

6. Dispenser of claim 2 wherein said air-squeeze bulb frictionally engages over said air input channel and is easily removed therefrom.

7. Dispenser of claim 2 wherein said lever means frictionally rotates in pivot sockets, said pivot sockets molded into said configured housing.

8. Dispenser of claim 2 wherein said tube has a height slightly less than the height of the top of the bottle whereby the top of said tube extends up to but slightly below the bottom of said bottle.

9. In combination, dispenser and a bottle of liquid catsup of a medium consistency, said bottle including a tapered neck; including:

a. housing including a round base, an upward rising vertical cylindrical chamber having a finite width; a plurality of keyways extending inwardly at a top edge from an inner diameter of said chamber; a fluid flow horizontal chamber extending from a mid portion of said vertical cylindrical chamber, through said finite width of said vertical cylindrical chamber and connecting to a spout; said spout including a substantially rectangular hole through a spout member, said spout connected to said horizontal chamber; an air flow chamber extending in a U-shaped configuration substantially down through a forward portion of said housing, through said housing, into said interior of said vertical cylindrical chamber, and including a socket for receiving an air tube in said vertical cylindrical chamber; an air tube engaged into said socket and extending upward through said neck of said bottle; a right angle lever including a cylindrical member, perpendicular pivot rods extending outwardly therefrom, said pivot rods riding in pivot grooves of said housing, a horizontal spout closure extending from said cylindrical member and partially through said rectangular hole, a vertical air bulb actuator extending from said cylindrical member and up through said air flow chamber; air bulb including a defined volumetric chamber and connected to said air flow chamber, said air bulb configured to encompass said vertical air bulb actuator and a portion of said neck of said bottle; and spring means between said vertical air bulb actuator and the input air channel wall; and, b. catsup bottle including a neck, a screw top lip about an upper diameter, and a configured base portion affixed to said tapered neck for holding a quantity of catsup.

* * * * *